US009058800B2

(12) United States Patent
Fazioli

(10) Patent No.: US 9,058,800 B2
(45) Date of Patent: Jun. 16, 2015

(54) SOUNDING BOARD FOR MUSICAL INSTRUMENTS

(71) Applicant: FAZIOLI PIANOFORTI S.p.A., Sacile (IT)

(72) Inventor: Paolo Fazioli, Sacile (IT)

(73) Assignee: FAZIOLI PIANOFORTI S.P.A. (IT)

( * ) Notice: Subject to any disclaimer, the term of this patent is extended or adjusted under 35 U.S.C. 154(b) by 0 days.

(21) Appl. No.: 14/538,211

(22) Filed: Nov. 11, 2014

(65) Prior Publication Data

US 2015/0128782 A1 May 14, 2015

(30) Foreign Application Priority Data

Nov. 13, 2013 (IT) ..... VR2013A0244

(51) Int. Cl.

| | |
|---|---|
| ***G10K 11/172*** | (2006.01) |
| ***B27M 1/08*** | (2006.01) |
| ***B27M 3/00*** | (2006.01) |

(52) U.S. Cl.

CPC ..... *G10K 11/172* (2013.01); *B27M 1/08* (2013.01); *B27M 3/0086* (2013.01)

(58) Field of Classification Search

CPC ..... G10C 3/04; G10D 1/005; G10D 3/02; G10D 1/085; G10D 3/00; G10D 3/06; G10D 9/00

USPC ..... 84/193, 194, 195, 173, 291

See application file for complete search history.

(56) References Cited

U.S. PATENT DOCUMENTS

| | | | | |
|---|---|---|---|---|
| 4,348,933 | A * | 9/1982 | Kaman et al. | 84/193 |
| 4,510,837 | A * | 4/1985 | Keller | 84/184 |
| 5,469,769 | A | 11/1995 | Sawada et al. | |

FOREIGN PATENT DOCUMENTS

| | | |
|---|---|---|
| GB | 760 872 | 11/1956 |

OTHER PUBLICATIONS

Italian Search Report dated May 14, 2014 issued in corresponding Italian patent application No. VR2013A000244.
Italian Written Opinion dated May 14, 2014 issued in corresponding Italian patent application No. VR2013A000244.

* cited by examiner

*Primary Examiner* — Kimberly Lockett
(74) *Attorney, Agent, or Firm* — Ostrolenk Faber LLP

(57) ABSTRACT

A sounding board (1) for musical instruments having a first plurality of planks (2) in which each plank (2*i*) of the plurality of planks (2) is provided with respective longitudinal sides (2*ia*, 2*ib*); wherein the planks (2) of the first plurality of planks are approached to one another, each one at the respective longitudinal sides (2*ia*, 2*ib*), so as to form a first panel (P1) of the sounding board (1); a second plurality of planks (3) in which each plank of the plurality (3) of planks (3*i*) is provided with respective longitudinal sides (3*ia*, 3*ib*); wherein the planks (3*i*) of the second plurality of planks (3) are approached to one another, each one at their respective longitudinal sides (3*ia*, 3*ib*), so as to form a second panel (P2) of the sounding board (1); in which the first and the second panel (P1, P2) are overlapping with one another with their respective planks (2*i*, 3*i*) extending along the same angled direction (A) of the sounding board (1); wherein the planks (2*i*) of the first plurality of planks (2) are staggered with respect to such planks (3*i*) of the second plurality of planks (3) so that the longitudinal sides (2*ia*, 2*ib*) of each one of the planks (2*i*) of the first plurality of planks (2) are misaligned with respect to such longitudinal sides (3*ia*, 3*ib*) of each one of the planks (3*i*) of the second plurality of planks (3).

14 Claims, 5 Drawing Sheets

SOUNDING BOARD FOR MUSICAL INSTRUMENTS

CROSS-REFERENCE TO RELATED APPLICATIONS

The present application claims benefit of Italian patent application no. VR2013A000244, filed Nov. 13, 2013, the contents of which are incorporated herein by reference.

TECHNICAL FIELD OF THE INVENTION

The present invention relates to a sounding board for musical instruments and, more particularly, to a sounding board for a piano.

BACKGROUND OF THE INVENTION

It is known that a sounding board for a piano is generally made of a plank or wood panel, for example of fir wood with a thickness of about 10 mm, the configuration of which essentially corresponds seen from above to the shape of the piano (as shown in FIG. 1 with regard to a grand piano).

Such boards or panels are usually made from a plurality of wooden planks laid side by side and attached to each other along their respective sides. The planks of the sounding board, as is well known, are cut from a respective wooden trunk, so that in each plank the upper face and the lower face either have longitudinal veins (with technical term called "bacon") parallel to each other and parallel to the sides of the planks, or in other words, perpendicular to the plane delimited by the head and tail face of the plank (see FIG. 2, showing one among a plurality of available cutting methods).

In a traditional sounding board, each plank has a width of about 8-12 cm, a thickness of 10 mm and a different length depending on the position it takes in the sounding board.

To make a sounding board the planks of the plurality of planks are laid side by side at their respective longitudinal sides, and are bound together using a suitable adhesive material. Then they are cut in order to take a diagonal or "angled" direction with respect to the sounding board itself, as shown in FIG. 3.

Now, the board so obtained has a good bending strength in the direction of the veins of the respective planks, but has a low bending strength along a direction perpendicular to the same, for which reason the application is necessary, by an adhesive, of a plurality of cross elements, (in technical term also called "ribs" or "chains") which are fastened to the lower face of the sounding board and are laid parallel one to another and perpendicular to the direction of the veins of the planks of the same (FIG. 4).

Traditional sounding boards suffer from many drawbacks.

First of all, in the course of time, cracks of the sounding board are found along the veins of the planks from which it is made. This is due to the natural drying of the wooden fibers making up the planks of the sounding board, which in the course of time are reduced in volume to a greater extent along the direction perpendicular to the veins, which causes in the same direction the loss of compression of the sounding board.

In general other factors also affect the occurrence of such cracks, among which:

- the type of adhesive used for gluing the planks, for applying the cross elements or chains on the sounding board and for applying to the board other components of the piano as, for instance, the bridges;

- the fact that the sounding board itself is bound at its peripheral ends to the structure of the piano, and as is known, it is kept compressed by the strings of the piano;
- the kind and quality of wood used to make the planks that make up the sounding board;
- the irregularities of the planks themselves, the profile of which could not be perfectly linear.

This drawback due to the cracks of the sounding board occurs in the course of time, to a greater extent in Countries characterized by a cold and dry climate and, in general, in environments with under-floor heating.

The cracks can obviously limit the function of the piano reducing its value, not to mention their repairs, in addition to being onerous from the economic point of view, and require long and laborious operations to remove the strings and the frame of cast iron from the sounding board and their subsequent replacement, once having completed the repairs.

Main aim of the present invention is therefore to provide a sounding board for musical instruments in which the likelihood of the occurrence of cracks of the same is set to zero or at least is greatly reduced.

Another aim of the present invention is to provide a sounding board for musical instruments which is less sensitive to the climate changes with respect to the traditional sounding boards.

Further aim of the present invention is to provide a sounding board for musical instruments the quality of which is greater than that of the traditional sounding boards.

Not least aim of the present invention is to provide a method of assembling a sounding board for musical instruments which is easy to implement.

SUMMARY OF THE INVENTION

According to a first aspect of the present invention a sounding board for musical instruments is provided, comprising:

- a first plurality of planks in which each plank of such plurality of planks is provided with respective longitudinal sides; wherein the planks of such first plurality of planks are mutually laid side by side, each one at their respective longitudinal sides, to make up a first panel of the sounding board;
- a second plurality of planks in which each plank of such plurality of planks is provided with respective longitudinal sides; wherein the planks of such second plurality of planks are mutually laid side by side, each one at their respective longitudinal sides, making up a second panel of the sounding board;

in which the first and second panel of the sounding board are overlapping one another with their respective planks extending along the same angled direction of the sounding board;

characterized by the fact, that the planks of the first plurality of planks are staggered with respect to the planks of the second plurality of planks so that the longitudinal sides of each one of the planks of the first plurality of planks are misaligned with respect to the longitudinal sides of each one of the planks of the second plurality of planks.

According to another aspect of the present invention a method is provided for assembling a sounding board according to the first aspect of the present invention, comprising the following operating steps of:

- preparing a first plurality of planks, each one having respective longitudinal sides;
- approaching and attaching to one another the planks of such first plurality of planks along their respective longitudinal sides;

cutting the planks so attached to one another following a predetermined profile of the sounding board, so that the planks are all placed with the same angled position in the sounding board, so obtaining a first panel of the sounding board;

preparing a second plurality of planks, each one having respective longitudinal sides;

approaching and attaching to one another the planks of such second plurality of planks along their respective longitudinal sides;

cutting the planks so attached to one another following such predetermined profile of the sounding board, so that the planks are all placed with the same angled position with respect to the sounding board, so obtaining a second panel of the sounding board;

attaching the first and the second panel to one another.

BRIEF DESCRIPTION OF THE DRAWINGS

Further aspects and advantages of the present invention will be better understood on the basis of following detailed description of some of its currently preferred embodiments, illustrated merely as an example and in a non limitative way in the annexed drawings, in which.

DESCRIPTION OF EMBODIMENTS

Figure 1:
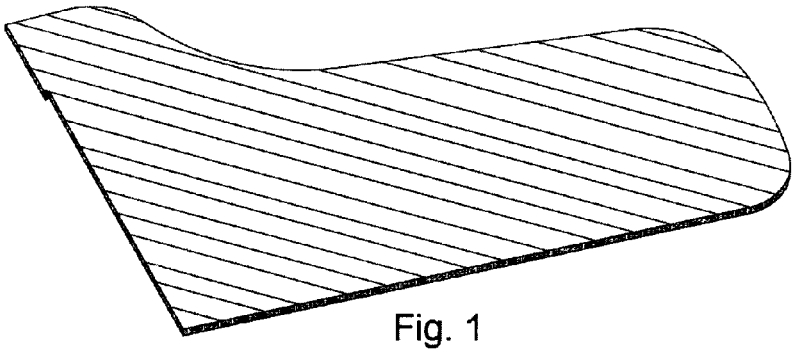
FIG. 1 is a perspective view of a sounding board for a grand piano according to the known art.
Figure 2:
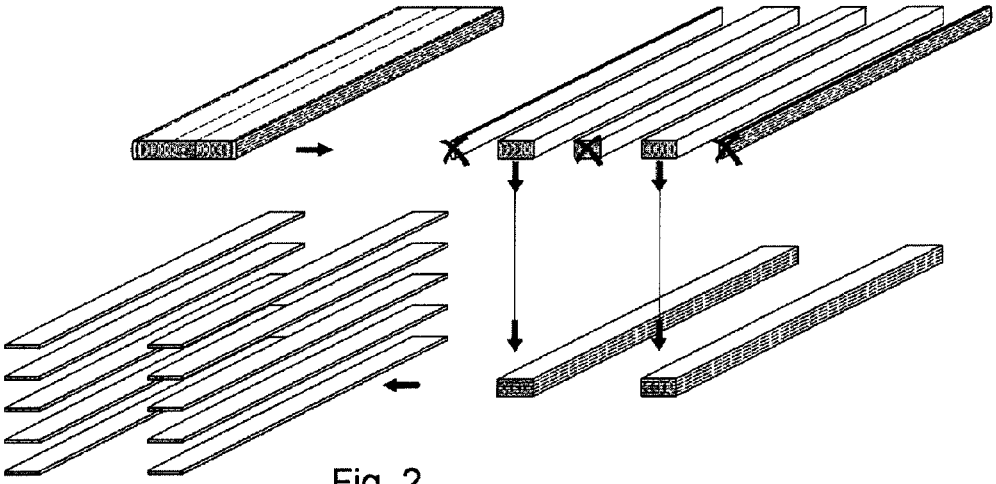
FIG. 2 schematically shows a method used for making up the planks of the sounding board according to the known art.
Figure 3:
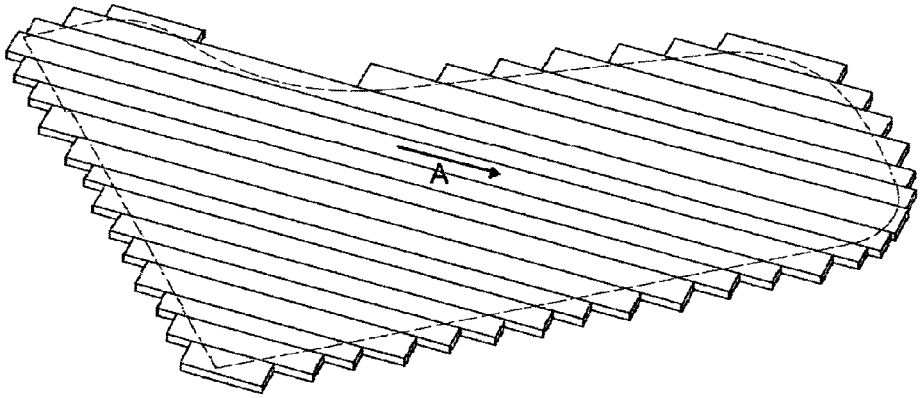
FIG. 3 shows a traditional sounding board comprising a plurality of planks closely placed together in an angled or "diagonal" direction with respect to the plank itself.
Figure 4:
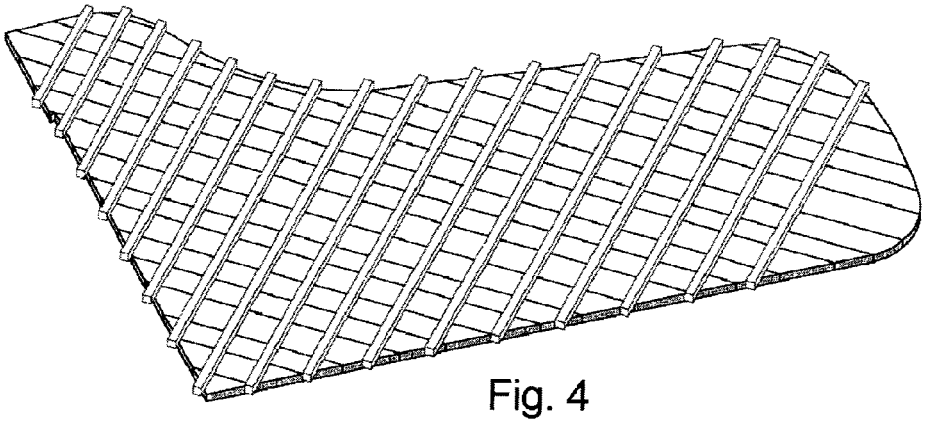
FIG. 4 shows the lower face of a traditional sounding board, to which a plurality of cross elements is attached.

In annexed drawings, same or similar parts or components have been characterized by the same reference characters.

Figure 5:
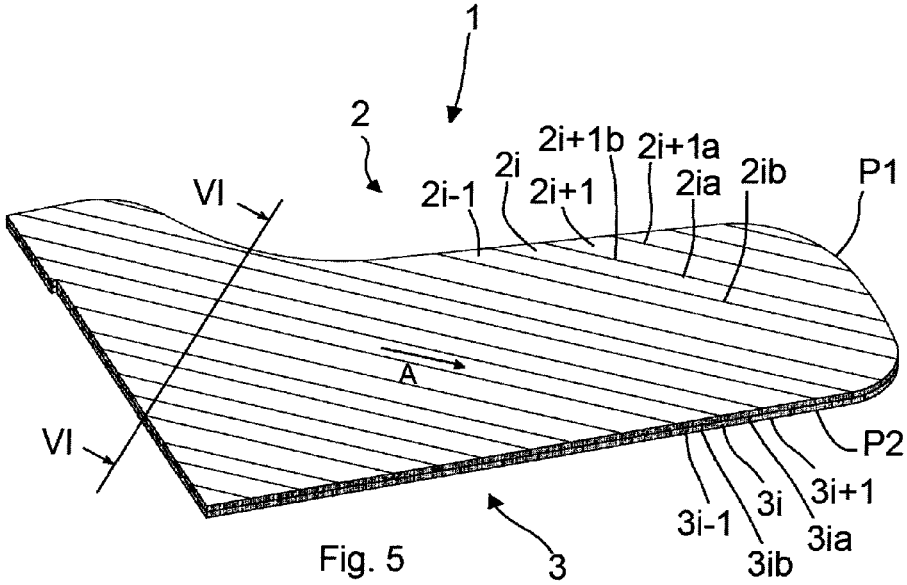
FIG. 5 is a perspective view, slightly from above, of a sounding board according to the present invention.
Figure 6:
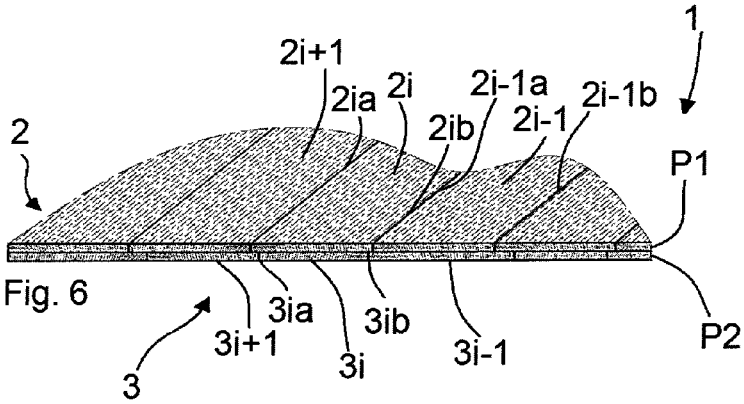
FIG. 6 shows a sectional enlarged view, along line VI of FIG. 5, of a length of sounding board according to the present invention.

Referring first to FIGS. 5 and 6, it should be noted that a sounding board for musical instruments according to the present invention is generally indicated with the reference character 1 and comprises a first panel P1, made of a first plurality of planks 2, which is overlapping with a second panel P2 in turn made of a second plurality of planks 3. The first and second panel P1 and P2 have a substantially identical configuration seen from above and substantially corresponding seen from above to the one of the respective musical instruments, particularly to a grand piano.

More particularly, each plank of the first plurality of planks 2, generally indicated with reference 2*i* (i=1, . . . , N) comprises respective longitudinal sides 2*ia*, 2*ib* at which (with the exception of a few planks at the peripheral ends of the panel P1) it is approached to adjacent planks (2*i*+1, 2i−1), to which it is attached through a respective adhesive, so forming the first panel P1 of the sounding board (1).

The same applies for the panel P2, in which each plank of the second plurality of planks 3 is generally indicated with the reference 3*i* (i=1, . . . , N) and comprises respective longitudinal sides (3*ia*, 3*ib*) at which (always with the exception of a few planks at the peripheral ends of the panel P2) it is approached to adjacent planks (3*i*+1, 3i−1), attached to it through a suitable adhesive, so forming the second panel P2 of the sounding board 1.

The planks in each panel P1 or P2, are placed extending parallel to one another along the same angled direction A, indicated with the arrow in FIG. 5, also called in slang "diagonal" of the panel and of the sounding board.

The panels P1 and P2 are stacked with their respective peripheral ends mating and are attached to one another through the use of a suitable adhesive, for example applied on the entire face of the panel P1 intended to come in contact with the panel P2, so as to form a sounding board the thickness of which is substantially made of the sum of the thicknesses of each panel.

Advantageously, the thickness of each panel P1, P2 is of about 5 mm, so that the sounding board formed by their overlap has a thickness of about 10 mm, or equal to that of the traditional sounding boards.

With such configuration, due to the natural variability of length of the planks utilized for the construction of each panel and of the respective wooden veins present on it, the planks 2*i* of the first panel P1 will be staggered with respect to the planks 3*i* of the panel P2, that is at a side 2*ia* or 2*ib* of a plank of the panel P1, a side 3*ia*, 3*ib* of a plank 3*i* will not lie in the panel P2 (see in particular FIG. 6).

Figure 8:
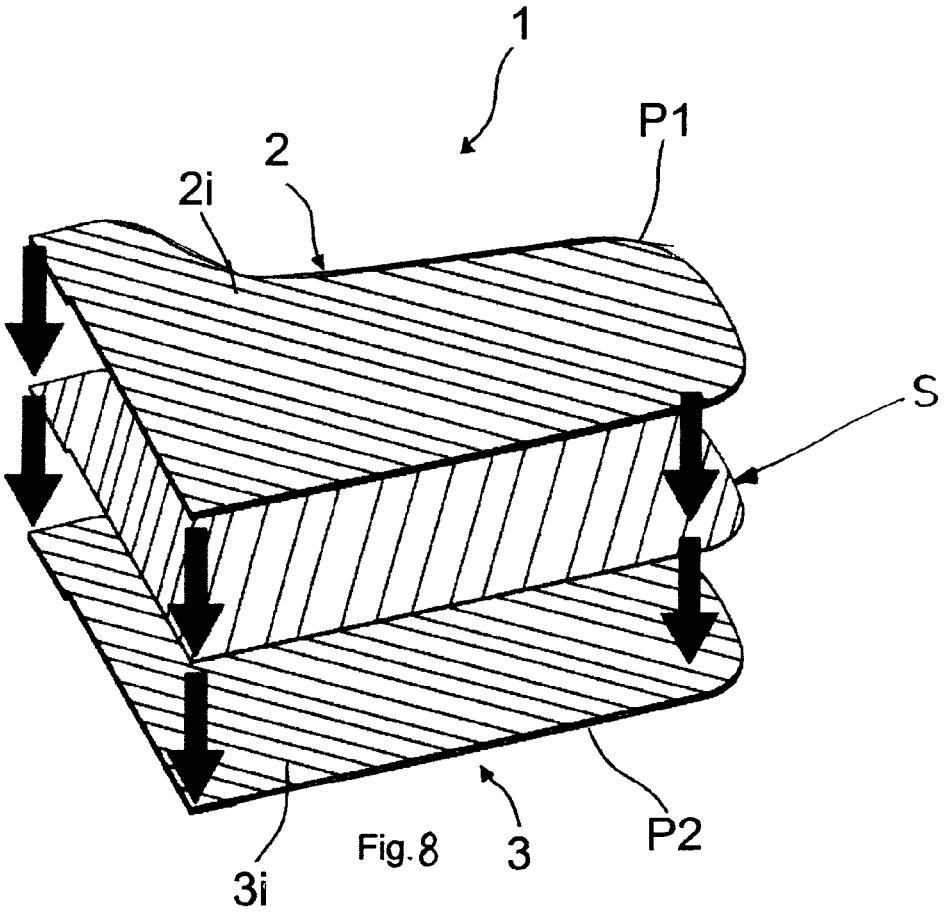
FIG. 8 shows a variant of the sounding board according to the present invention.

According to the variant shown in FIG. 8, in order to improve the stability of the sounding board 1 and to optimize the resistance against any cracks in the wood caused, for example, by the low humidity content of ambient air where the grand piano is housed, between two panels P1 and P2 an intermediate layer S is placed, preferably defined but not limited by a veneer IM with a determined reduced thickness (for example 6 tenth of a millimeter) of the same kind of wood (for example red fir) and with a wood vein oriented orthogonally with respect to the orientation of the wood veins of the two panels P1 and P2 themselves.

In this way the possibility of cracks of the wood of the sounding board 1 is substantially eliminated, with the intermediate layer cited which helps to homogenize and stabilize the sounding board 1 and to further improve the efficiency of vibration of the board 1 itself.

According to a variant not shown, the intermediate layer S is defined by a layer made of a non-woody material, for example carbon fiber, kevlar or equivalent material with fibers preferably oriented orthogonally with respect to the wood veins of the two panels P1 and P2, in order to cause a further stabilization of the sounding board 1 without any cracks.

Figure 7:
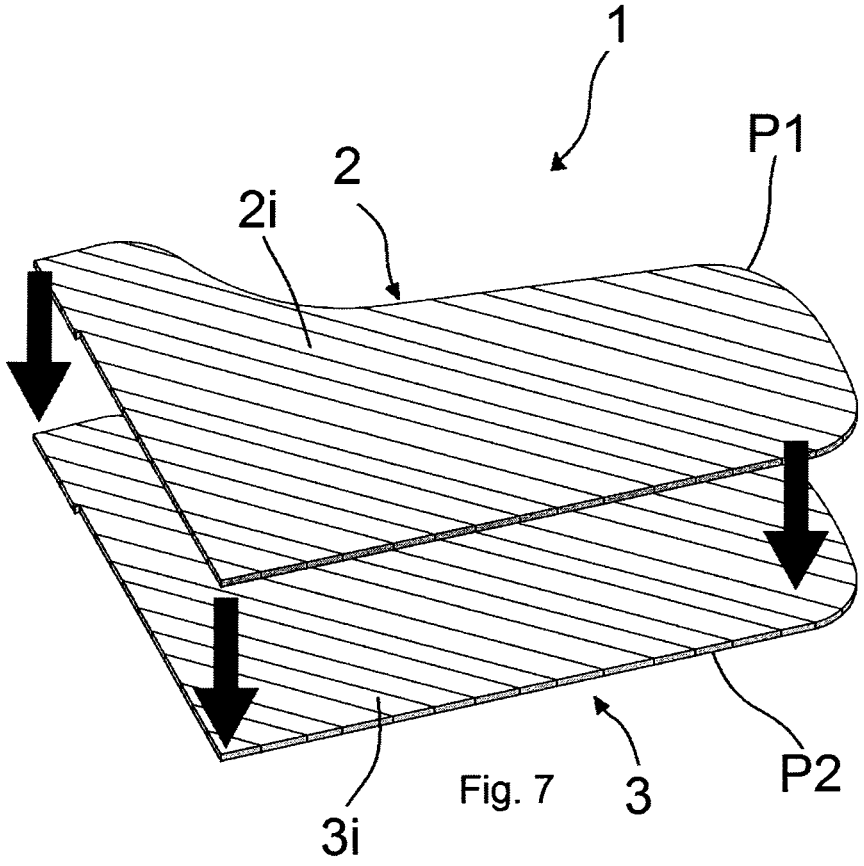
FIG. 7 shows one step of the assembly method of the sounding board according to the present invention.

The assembly of a sounding board according to the present invention is very simple and requires to:

prepare a first and a second plurality of planks 2 and 3;

attach juxtaposed planks 2*i*, 3*i* of each plurality 2, 3 along their respective longitudinal sides of each plank;

cut each plurality of planks 2, 3 so attached according to a predetermined profile of the sounding board, so that the planks are all placed according to the same angled direction A of the sounding board, so obtaining the respective profiled panel P1 or P2; and attach the first and second panel P1, P2 overlapping one with another with their peripheral ends substantially coincident (reference is made to FIG. 7).

As a person skilled in the art will understand, the steps relating to the construction of the first panel P1 and of the second panel P2 can be inverted.

It will also easily be understood that, with such configuration of the sounding board, the danger of the occurrence of cracks is completely canceled or in any case it is dramatically reduced. In fact, also in environments characterized by a low humidity, the layer of adhesive between the panels P1 and P2 will stiffen the structure of the sounding board itself, so as to prevent that the planks of each panel separate one from another, so producing the cracks cited before.

It will then be noted that the casual distribution of the veins in each plank 2*i* or 3*i* prevents the formation of the cracks even if they extend along the same angled direction A in both panels P1 and P2. Should in fact a crack be formed either along a vein of a plank 2*i* or 3*i* or between a plank 2*i*, 3*i* and the plank 2*i*+1, 3*i*+1 adjacent to it, the adhesive between the panels P2 or P1 will contribute at the crack to maintain mutually bound the edges of the crack so preventing the occurrence of a through opening in both panels.

To that purpose, experimental tests have been performed in which the behavior of two samples of a sounding board have been detected, the one made according to the known art and the other according to the present invention, which were submitted to extreme working conditions.

A first sample, sample A, was made according to the traditional art in one panel made of planks of red fir, the thickness of which was of about 8 mm. The second sample, sample B, was made according to the present invention, overlapping two panels P1 and P2 each one with planks, still made from red fir, with a thickness of about 4 mm.

Both samples A e B, having a dimension of about 500×300 mm, were each glued on a respective maple frame with a thickness of about 34 mm, and were submitted to the same pre-conditioning step in the cell, during which they were maintained for 6 days at the conditions of 20±2° C. and 35±5 relative humidity, and to subsequent controlled heating steps in a stove at following temperatures:

exposures for 8 hours at 30±2° C.;
exposures for 7 hours at 35±2° C.;
exposures for 8 hours at 40±2° C.;
exposures for 15 hours at 45±2° C.;
exposures for 23 hours at 50±2° C.

Between one exposure and the subsequent one, the samples A and B were left to cool.

During the exposures, at predetermined time intervals, the main parameters of each sample were measured (weight in grams, percentage change with respect to initial weight and length) and the general conditions of its appearance (presence or absence of bulges and/or cracks).

However, it was found that a first through crack, extended along the entire length of sample A according to the known art, occurred at a junction between two adjacent planks after 15 hours of exposure at 45±2° C. With equal conditions, for sample B according to the present invention only a small bulge was observed, at a junction between one plank and another.

Concerning the sample B of the sounding board made according to the present invention, a first non-through crack in one of the two panels that compose it, was observed after 19 hours of exposure at 50±2° C., when the through crack of the sample A of the sounding board according to the known art was now extended. Due to extreme working conditions, as it is obvious, it is clear that in a sounding board according to the present invention the likelihood of the occurrence of cracks is dramatically reduced if not completely set to zero.

Furthermore the person skilled in the art will easily understand that a sounding board according to the present invention, having a thickness substantially similar to that of the traditional sounding boards, can be submitted to the same subsequent treatments to which the traditional sounding boards are submitted.

That being said, it was found that a sounding board according to the present invention advantageously allows the generation of a sound of a better quality with respect to that which can be obtained, at the same conditions, with a traditional sounding board. Previous technical tests lead to the conclusion that homogenizing the sounding board, through the usage of an adhesive between the two panels P1 and P2, make the sounding board uniform making it less dependent on center and acute frequencies.

Another advantage which was found in the sounding board according to the present invention is to allow for a better tuning stability of the instrument on which it is mounted. This is due to the fact that the sounding board described before is more stable with respect to the stresses undergone in use.

A further advantage found is that the sounding board of the present invention, just as a consequence of the homogenization reached by the adhesive, is less dependent on the often variable quality of the kind of wood used for its construction.

If desired, the sounding board according to the present invention can be also constructed with different kinds of wood, for example one for the first panel P1 and one for the second panel P2.

Advantageously, the sounding board according to the present invention also reduces possible regularity defects of the planks 2*i* and 3*i* used for its construction, so providing a more regular and more intense frequency response, as the energy dispersed inside the material is dramatically reduced.

The sounding board and the assembly method of the same as described before are susceptible to numerous modifications and variants within the protection field defined by the claims.

So for example the first and the second panel P1 and P2 can be produced with planks made from the same kind of wood or from a wood of a different kind.

With reference to the assembly method, before the steps of preparing the first and the second plurality of planks 2 and 3, a previous step can be made for determining the dimension and the position of each plank 2*i*, 3*i* in the sounding board, so that the longitudinal sides 2*ia*, 2*ib* of each plank 2*i* of the first plurality of planks 2 are misaligned in the assembled sounding board, or in any case are not overlapping with respect to the longitudinal sides 3*ia*, 3*ib* of each one of the planks 3*i* of the second plurality of planks 3.

In this case, after such step, a step of cutting to size of the planks 21 and 3*i* of the plurality 2 and 3 will be optionally provided, so that for the construction of the respective panels P1 and P2 it will be sufficient to mutually approach and attach to one another the respective planks according to the position determined at the previous step.

The invention claimed is:

1. Sounding board for musical instruments, comprising:

a first plurality of planks in which each plank of said plurality of planks is provided with respective longitudinal sides, wherein said planks of said first plurality of planks are mutually approached, each one at the respective longitudinal sides, in order to form a first panel of said sounding board;

a second plurality of planks in which each plank of said plurality of planks is provided with respective longitudinal sides, wherein said planks of said second plurality of planks are mutually approached, each one at the respective longitudinal sides, in order to form a second panel of said sounding board, wherein said first and second panel are mutually overlapping with the respective planks extending along the same angled direction of said sounding board, wherein said planks of said first plurality of planks are staggered with respect to said planks of said second plurality of planks, so that said longitudinal sides of each one of said planks of said first plurality of planks are misaligned with respect to said longitudinal sides of each one of said planks of said second plurality of planks.

2. Board according to claim 1, wherein said first and said second panel are connected one to another through an adhesive.

3. Board according to claim 1, wherein said planks of said first and/or second plurality of planks have a thickness of about 5 mm.

4. Board according to claim 1, wherein such planks of said first and second plurality of planks are made of fir wood.

5. Board according to claim 1, wherein such planks of said first plurality of planks are made of a different kind of wood with respect to that from which said planks of said second plurality of planks, are made.

6. Board according to claim 1, further comprising an intermediate stabilizing layer made of a material placed between said first and second panel.

7. Board according to claim 6, wherein such intermediate layer is made of wood and is provided with veins orthogonally placed with respect to the veins of said first and second panel.

8. Method for assembling a sounding board, comprising following operating steps of:

preparing a first plurality of planks, each having respective longitudinal sides;

mutually approaching and attaching said planks of said first plurality of planks along their respective longitudinal sides;

cutting the planks so attached to one another according to a predetermined profile of said sounding board, so that the planks are all placed according to the same angled direction in said sounding board, so obtaining a first panel of said sounding board;

preparing a second plurality of planks, each having respective longitudinal sides;

mutually approaching and attaching to one another such planks of said second plurality of planks along their respective longitudinal sides;

cutting the planks so attached to one another according to said predetermined profile of said sounding board, so that the planks are all placed according to the same angled direction in said sounding board, so obtaining a second panel of said sounding board; and attaching to one another said first and said second panel.

9. Method according to claim 8, wherein such steps of preparing a second plurality of planks, approaching and attaching to one another such planks of a second plurality of planks and of cutting said planks so fixed according to said second predetermined profile of said sounding board, precede the corresponding steps referring to said first plurality of planks.

10. Method according to claim 8, wherein such step of attaching to one another said first and said second panel comprises the step of overlapping with one another said panels with their respective peripheral ends coinciding.

11. Method according to claim 8, wherein such step of attaching to one another said first and said second panel comprises the use of a suitable adhesive.

12. Method according to claim 8, wherein between said first and second panel an intermediate stabilizing layer is inserted, made of a determined material.

13. Method of assembling a sounding board, comprising following operating steps:

preparing a first plurality of planks, each having respective longitudinal sides;

preparing a second plurality of planks, each having respective longitudinal sides;

determining the dimension and the position of each plank of said plurality of planks in each panel so that such longitudinal sides of each one of said planks of said first plurality of planks, with the sounding board assembled, are misaligned with respect to said longitudinal sides of each one of said planks of said second plurality of planks;

cutting to size said planks according to the dimensions so determined;

approaching and attaching to one another said planks of said first and second plurality of planks along their respective longitudinal sides and according to the position so determined, so obtaining said first and said second panel; and attaching to one another said first and said second panel.

14. Method according to claim 13, wherein such mutual attaching of said first and second panel is made by interposing between said panels an intermediate layer of a determined material.

* * * * *